US006932670B1

(12) United States Patent
Lambrinos

(10) Patent No.: US 6,932,670 B1
(45) Date of Patent: Aug. 23, 2005

(54) SIGNALING SYSTEM FOR SANDBLASTING

(76) Inventor: Jon M. Lambrinos, 84 Creed Cir., Campbell, OH (US) 44405

( * ) Notice: Subject to any disclaimer, the term of this patent is extended or adjusted under 35 U.S.C. 154(b) by 0 days.

(21) Appl. No.: 10/896,140

(22) Filed: Jul. 22, 2004

(51) Int. Cl.[7] ..... B24C 3/00
(52) U.S. Cl. ..... 451/2; 451/78
(58) Field of Search ..... 451/2, 36, 37, 451/38, 39, 40, 75, 78, 90, 91

(56) References Cited

U.S. PATENT DOCUMENTS 5,216,848 A * 6/1993 Abbott et al. ..... 451/2
5,239,787 A * 8/1993 Abbott et al. ..... 451/2
5,283,991 A * 2/1994 Keizers ..... 451/101
5,367,840 A * 11/1994 West ..... 451/78
5,934,971 A * 8/1999 Thompson et al. ..... 451/2
2004/0202980 A1 * 10/2004 Policicchio ..... 433/88

* cited by examiner

*Primary Examiner*—Jacob K. Ackun, Jr.
(74) *Attorney, Agent, or Firm*—Renner, Kenner, Greive, Bobak, Taylor & Weber

(57) ABSTRACT

A sandblasting operation includes a nozzle (10) which receives sand from a pot (12). A signaling system (20) for the sandblasting operation includes a first switch (22) to initiate the operation and a second switch (24) located at the nozzle (10) to alert the operator of the pot (12) of the need for action and also of the type of action needed. If the second switch (24) is put in one position, an alarm (29) is sounded alerting the operator of the pot (12), and a first light (30) is illuminated to indicate the need for an increased amount of sand. If the second switch (24) is put in a second position, the alarm (29) is sounded and a second light (31) is illuminated to indicate the need for a decreased amount of sand.

20 Claims, 1 Drawing Sheet

SIGNALING SYSTEM FOR SANDBLASTING

TECHNICAL FIELD

This invention relates to a system whereby the operator of a sandblasting nozzle may send information to a remote location to the person controlling the supply of the sand or other abrasive. More particularly, this invention relates to such a system which not only alerts the person at the remote location to the need for action, but also dictates to that person the type of action to be taken.

BACKGROUND ART

Sandblasting is a process in which an abrasive, such as sand, is discharged from a sandblasting gun or nozzle against a surface to be cleaned in preparation for painting or some other process. A supply of sand or other abrasive is carried in a "pot," and upon activation of the system, an operator allows the sand to travel from the pot and through a hose to be discharged through the nozzle.

The supply pot of the abrasive and its operator are most often at a location remote from, and sometimes out of the sight of, the blasting site. For example, if a bridge is being sandblasted, the pot and its operator will be on the ground, remote from the bridge, and often the sandblasting person will be out of the sight of the pot operator, possibly hundreds of feet away. Oftentimes during the blasting operation, there is a need to adjust the amount of sand flowing through the hose. The communication of this need from the blaster to the pot operator is a significant problem. Even if the blaster and the operator were within normal earshot, the noisy environment of the sandblasting operation makes it difficult, if not impossible, for these two people to orally communicate. Hand signals are not a solution because, as discussed above, the blaster may be out of the sight of the pot operator, and even if the two had visual communication, due to other duties, the pot operator cannot focus his attention constantly on the blaster.

Most often, the blaster uses some kind of code to attempt to communicate with the pot operator. That is, if the blaster needs a larger flow of abrasive, he may quickly turn the nozzle on and off, for example, three times, and if a smaller flow of abrasive is needed, he may quickly turn the nozzle on and off two times. If the pot operator observes this activity, he will then be able to adjust the abrasive supply accordingly. However, this not only requires that the pot operator be nearby the pot, but it also requires that he has his full attention on the pot at all times. Even then, in view of the noisy environment, the pot operator may not recognize the signal being transmitted.

Thus, the need exists for a system which will allow the blasting nozzle operator to communicate with the pot operator not only the need for action, but also the type of action to be taken.

DISCLOSURE OF THE INVENTION

It is thus an object of the present invention to provide a system by which a blasting nozzle operator and an abrasive pot operator may communicate.

It is another object of the present invention to provide a system, as above, in which the blasting nozzle operator may not only communicate the need for action to the pot operator, but also communicate the type of action desired.

It is a further object of the present invention to provide a system, as above, in which the constant attention of the abrasive pot operator is not required.

These and other objects of the present invention, as well as the advantages thereof over existing prior art forms, which will become apparent from the description to follow, are accomplished by the improvements hereinafter described and claimed.

In general, a signaling system for a sandblasting operation made in accordance with the present invention includes a first switch to initiate the operation and a second switch which is capable of being positioned in one of two positions. When in a first position, an audible alarm is activated and a first light is illuminated. When in a second position, the audible alarm is activated and a second light is illuminated.

The present invention also contemplates a method of communicating with an operator in a sandblasting operation. This method includes the steps of alerting the operator of the need for attention and identifying to the operator the type of attention required.

The sandblasting system of the present invention includes a sandblasting nozzle, a supply of sand, and a hose connected between the supply of sand and the nozzle. A first switch initiates the movement of sand from the supply, through the hose, and to the nozzle. A second switch signals the need for an adjustment in the amount of sand being supplied.

A preferred exemplary signaling system for sandblasting according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
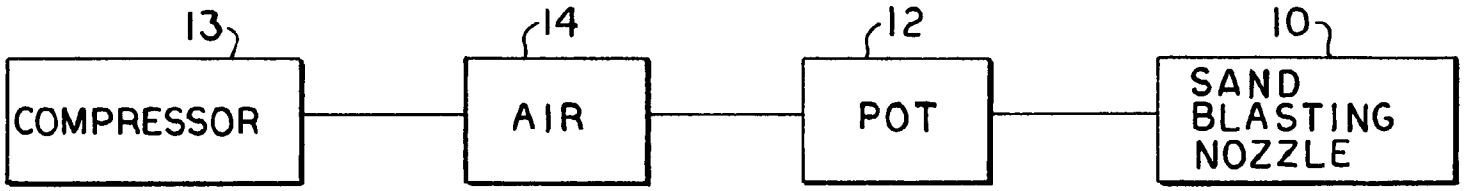
FIG. 1 is a block diagram schematically showing a sandblasting operation.

A sandblasting operation is schematically shown in FIG. 1 as including a sandblasting nozzle 10 connected by a hose 11 to a conventional pot 12. Pot 12 carries a supply of an abrasive, such as sand, and is often very remote from the operator of nozzle 10. Thus, the operator of the nozzle 10 is often out of the sight of the operator of the pot. A compressor 13 provides air 14 to the pot 12 to entrain the sand and provide the same to the nozzle 10. A pinch valve associated with the pot 12 operates on hose 11 to control the amount of abrasive being received at nozzle 10 and otherwise turns the system on or off.

Figure 2:
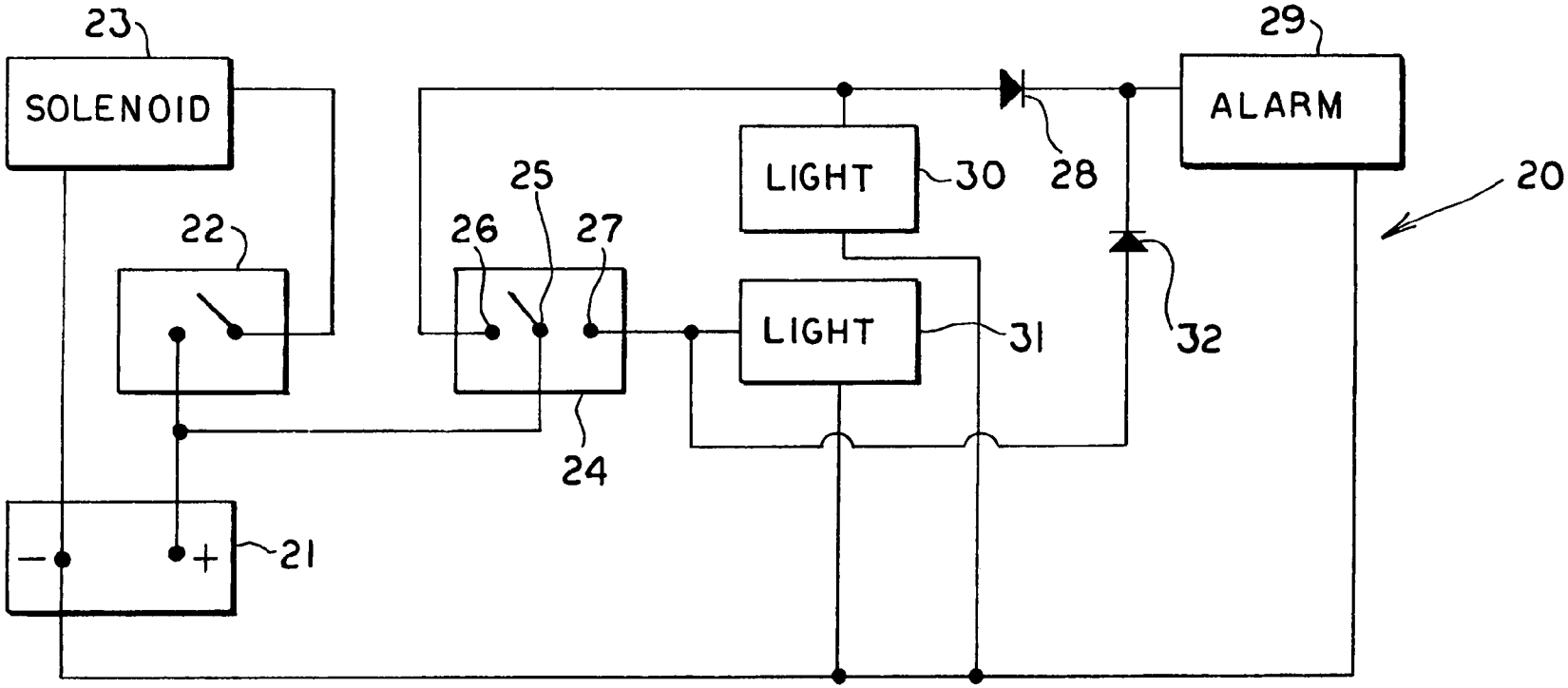
FIG. 2 is a schematic circuit diagram of a signaling system made in accordance with the concept of the present invention.

As previously described, oftentimes the operator of nozzle 10 will need to have the supply of the sand adjusted, upwardly or downwardly, to meet certain sandblasting needs. Thus, somehow the operator at the site of pot 12 must be alerted to the need for more sand or less sand, as the case might be, so that he can adjust the pinch valve accordingly to adjust the flow of the sand. The present invention provides such an alert system, and is indicated generally by the numeral 20 in FIG. 2.

Control system 20 can operate off of a conventional twelve volt power supply 21. The sandblasting nozzle 10 is provided with a first switch 22 which conventionally operates a solenoid 23 to turn the sandblasting operation on or off. In accordance with the present invention, the nozzle 10 is also provided with a second switch 24. Switch 24 is of the single pole, double throw, type and thus has a throw arm 25 connected to the positive side of power supply 21, and two terminals 26 and 27. Switch 24 is shown in the off position in FIG. 2, but by moving the arm 25 to engage either terminal 26 or 27, switch 24 is positioned in one of two conditions. These conditions accomplish two functions: First, the operator of pot 12 is audibly alerted to the fact that the operator of the nozzle 10 requires action, and second, the pot operator is visually alerted as to the type of action required, that is, more sand or less sand.

Thus, if switch arm 25 is moved to engage terminal 26, a circuit is closed through a diode 28 to operate an alarm 29 which may be any type of audible alarm which is loud enough to alert the operator of the pot that his assistance is required. At the same time, the circuit is closed through a first light 30 so that it is illuminated. First light 30 may, for example, be a green light to indicate to the pot operator that more sand is needed by the nozzle operator. As a result, the pot operator will adjust the pinch valve accordingly, and when the nozzle operator senses that he now has the correct sand supply, he can return switch arm 25 to the neutral or off position.

During this time, diode 28 prevents a second light 31 from being illuminated. This second light 31 is illuminated by moving switch arm 25 to engage terminal 27. Such closes a circuit through a diode 32 (which prevents light 30 from being illuminated) to operate alarm 29. At the same time, the illumination of light 31, which is preferably red, alerts the pot operator to reduce the sand supply, and once such has been returned to a point desired acceptable to the nozzle operator, switch 25 can be returned to the neutral or off position.

Thus, an alert system 20 constructed as described herein will first attract the attention of the pot operator with an audible alarm and then, by observing which light 30 or 31 is illuminated, he can determine the instructions being received from the sandblasting nozzle operator. As such, system 20 accomplishes the objects of the present invention and otherwise substantially improves the art.

What is claimed is:

1. A signaling system for a sandblasting operation comprising a first switch to initiate the operation, and a second switch, said second switch being capable of being positioned in one of two positions such that when positioned in a first position, an audible alarm is activated and a first light is illuminated, and when in a second position, said audible alarm is activated and a second light is illuminated.

2. The signaling system of claim 1 further comprising a diode to prevent said second light from being illuminated when said first light is being illuminated.

3. The signaling system of claim 2 further comprising a second diode to prevent said first light from being illuminated when said second light is being illuminated.

4. The signaling system of claim 1 wherein said switches are positioned on a sandblasting nozzle.

5. The signaling system of claim 1 wherein said first light is colored differently than said second light.

6. A method of communicating with an operator in a sandblasting operation comprising the steps of alerting the operator of the need for attention, and identifying to the operator the type of attention required.

7. The method of claim 6 wherein the step of alerting includes the step of providing an audible alarm.

8. The method of claim 7 wherein the step of identifying includes the step of selecting a light to be illuminated.

9. The method of claim 6 wherein the step of identifying includes the step of selecting a light to be illuminated.

10. The method of claim 6 wherein the attention required relates to the need for more or less sand being supplied in the sandblasting operation, and the step of identifying includes the step of selectively illuminating a first light if more sand is needed, and illuminating a second light if less sand is needed.

11. The method of claim 10 further comprising the step of maintaining the selected light illuminated until the supply of sand has been adjusted.

12. A sandblasting system comprising a sandblasting nozzle; a supply of sand; a hose between said supply and said nozzle; a first switch to initiate the movement of sand from said supply, through said hose, and to said nozzle; and a second switch to signal the need for an adjustment in the amount of sand being supplied.

13. The sandblasting system of claim 12 wherein said second switch also signals the type of adjustment in the amount of sand being supplied.

14. The sandblasting system of claim 13 further comprising a first light to be illuminated by said second switch if the amount of sand being supplied is to be increased and a second light to be illuminated by said second switch if the amount of sand being supplied is to be decreased.

15. The sandblasting system of claim 14 wherein said lights are of different colors.

16. The sandblasting system of claim 14 further comprising means to prevent said second light from being illuminated when said first light is illuminated and to prevent said first light from being illuminated when said second light is illuminated.

17. The sandblasting system of claim 12, said switches being located at said nozzle.

18. The sandblasting system of claim 12 further comprising an audible alarm near said supply of sand and activated by said second switch to signal the need for an adjustment in the amount of sand.

19. The sandblasting system of claim 18 further comprising first and second lights near said supply of sand, said second switch selectively operating said first or second light to signal the type of adjustment in the amount of the sand.

20. The sandblasting system of claim 19 further comprising means to prevent said second light from being illuminated when said first light is illuminated and to prevent said first light from being illuminated when said second light is illuminated.

* * * * *